United States Patent [19]

Peterson

[11] 4,388,779

[45] Jun. 21, 1983

[54] EASY-TO-OPEN, PRESSURE-RESISTANT DOOR ASSEMBLY

[76] Inventor: Carl R. Peterson, Elm St., Boxford, Mass. 01921

[21] Appl. No.: 232,639

[22] Filed: Feb. 9, 1981

[51] Int. Cl.[3] ..... E05D 15/28

[52] U.S. Cl. ..... 49/253; 49/135; 49/153; 49/390; 49/392; 98/50

[58] Field of Search ..... 49/135, 153, 390, 392, 49/393, 246, 253; 98/50

[56] References Cited

U.S. PATENT DOCUMENTS 1,478,303 12/1923 Snyder ..... 98/50 X
3,122,799 3/1964 Lunde ..... 49/392 X
3,953,940 5/1976 Zaslow ..... 49/135
4,055,024 10/1977 Frank ..... 49/390 X

FOREIGN PATENT DOCUMENTS 548991 11/1922 France ..... 49/392

*Primary Examiner*—Kenneth Downey

[57] ABSTRACT

Between regions of different air pressure, a door pivots on an axis located a substantial distance from the nearest edge; this edge moves inwardly as the door pivots about the door axis in a first phase of opening movement to relieve the difference in pressure on opposite sides of the door; pivot links then carry the door about a second axis, parallel to the first axis, in a second phase movement which moves the entire door outwardly to the open position.

12 Claims, 18 Drawing Figures

FIG 1
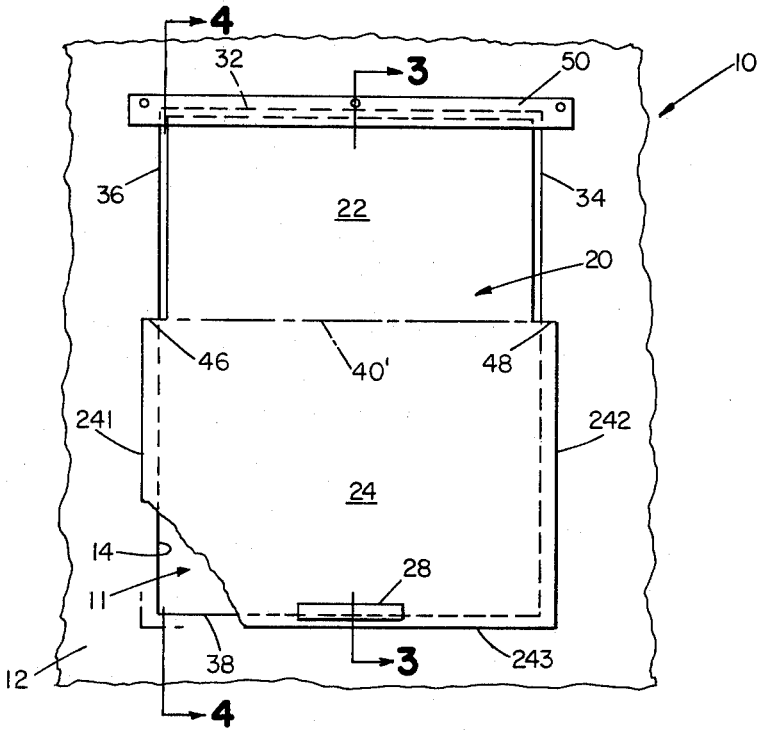
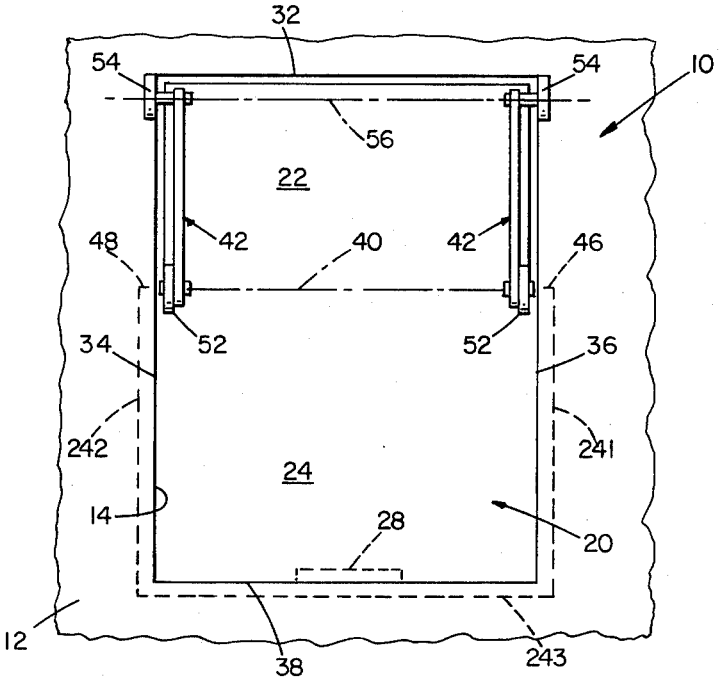
FIG 2
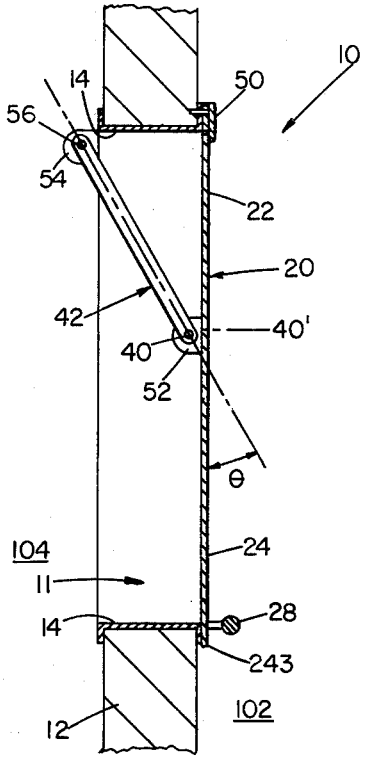
FIG 3

EASY-TO-OPEN, PRESSURE-RESISTANT DOOR ASSEMBLY

FIELD OF THE INVENTION

This invention relates to easy-to-open, pressure-resistant door assemblies for use between areas of different pressure; e.g., in mines or the like.

BACKGROUND OF THE INVENTION

Air circulation for ventilation of mine operations is achieved by means of a pressure drop in the mine produced by a ventilation fan either blowing air into the mine, or pulling air out of the mine. Many underground headings, i.e. main corridors, are arranged to carry air either from the surface to the workplace, or other areas requiring ventilation, or carry exhaust air back to the surface. Room and pillar mines, as commonly employed in coal mining, must, for safety reasons, have "cross cuts" or connecting paths between all headings. By law in the United States, cross cuts are required at least every 100 feet. This includes main intake and exhaust headings. In order to maintain the desired circulation path of ventilation air, these cross cuts are sealed by a partition or wall called a "stopping", typically constructed of concrete block, to prevent short circuit of the air flow. Many of these stoppings (by law in the United States, every other one) must contain a door to allow passage of personnel between the intake and the exhaust headings.

Each door, typically 32 inches square, must be manually operable by a miner and yet automatically remain closed to provide a seal against short circuiting of the air flow. Due to the pressure drop across the access opening caused by the flow of ventilation air, the force required to open these doors may be relatively large, e.g., assuming a typical door hinged from above, a common pressure drop of 2 inches of water (0.0722 psi), and a 32 inch square door with hinges 2 inches from the top and a handle 4 inches from the bottom, the force required to open the door would be 50 pounds, in addition to the weight of the door. Pressure drops of as much as 4 inches of water are common across doors near the intake or exhaust areas and the opening force required for these doors is proportionately larger. This excessive force requirement is particularly a problem for small employees or those who have been injured in mines. It is one objective of this invention to provide an improved pressure-balanced door that may be opened without excessive force.

The large pressure drop causes an additional problem after the door is opened. The air flow through the access opening can result in violent door closure. In typical operation, the door is propped or wedged open for use, and the last person through the opening reaches back to kick or pull out the wedge. The door closing, accelerated by air pressure (and also by gravity in an overhead hinged door), is very rapid and sufficiently violent to risk serious physical harm to operators. It is a further objective of this invention to provide a door between areas of different pressure that may be safely closed without violent force.

"Butterfly valve" doors which are hinged to pivot about the middle have been used in mining operations to eliminate the pressure load problem, but such a configuration requires a door and opening of twice the height of a standard door and, resultingly, nearly twice the potential leak path through the access opening. It is another objective of this invention to provide a door of minimum dimensions to reduce the potential for air leakage through the access opening.

Other, more complex pressure balancing doors, e.g. revolving doors or doors with sliding support or guide members, have been employed in mine operations in areas of high pressure differences, but more sophisticated designs are not compatible with dirty mining operations. It is an objective of this invention to provide a door of low cost and extremely simple configuration, that is easily installed, requires no precision manufacture, and avoids sliding support guidance members while providing a desirable degree of relief of opening and closing pressure load and, if desired, counterbalancing gravity loading.

SUMMARY OF THE INVENTION

This invention relates to an easy-to-open, pressure-resistant door assembly for an access opening of predetermined shape in a wall, the wall disposed between high and low air pressure regions in a mine or the like, and the door located on the high pressure side of the opening, with air pressure drop across the door serving to keep the door sealed.

According to the invention the door has a first edge corresponding to a first edge of the access opening with a door pivot axis spaced from this first door edge a substantial distance in the direction of the opposite second edge of the door; the first part of the door, between the first edge of the door and the door pivot axis, has a width slightly narrower than the corresponding part of the predetermined access opening to enable pivotal movement of the first part of the door about the door pivot axis inwardly of the access opening toward the low pressure region while the second part of the door, on the opposite side of the door axis, pivots outwardly; a pivot link means pivotally supports the door along the door pivot axis and extends to a link pivot axis parallel to the door pivot axis and located in the region of the first edge of the access opening; a limit means is adapted to limit the pivotal movement of the door about the door pivot axis; the pivot link means is arranged to swing the door pivot axis and the door supported thereby outwardly about the link pivot axis to move the door pivot axis in the direction toward a line projected perpendicular to the wall from the link pivot axis, and stop means adapted to prevent the part of the door adjacent the second edge from moving inwardly through the access opening, whereby, upon application of operator pressure for opening the door, the door can respond in a first phase motion by pivoting about the door pivot axis, the exposure to pressure difference of the first and second parts of the door on opposite sides of the door pivot axis tending at least partially to offset the pressure effects to enable the first phase motion to occur with relatively small operator pressure, this first phase motion enabling equilibration of air pressure on both sides of said door in the region of the access opening, and the link means enabling subsequent bodily swinging of the door about the link pivot axis in a second phase motion, to move the door to its open position.

In preferred embodiments the stop means comprises a peripheral margin of the second part of the door sized larger than the corresponding part of the opening, this margin adapted effectively to seat and seal against the wall; the limit means is adapted to limit the pivotal movement of the door about the door axis to an acute angle, preferably the link means serving as the limit means; the effective moment of the area of the first part of the door about the door pivot axis is less than the moment of the area of the second part of the door so that in the absence of operator pressure the effect of pressure differential acting on the two parts of the door is to produce an unbalance tending to rotate the door about the door pivot aixs in the direction to keep the door closed, with the door engaged with the stop means; the first edge of the opening is the upper edge of the opening, and the door is adapted to swing upwardly to a substantially horizontal position, projecting outwardly from the opening; preferably the pivot link means comprises a pair of links, one at each side of the access opening, these links extending substantially parallel from the link pivot axis to the door pivot axis; the link pivot axis is spaced inwardly from the high pressure side of the opening whereby the weight of the door promotes sealing of the door against the wall; the door is unbalanced in weight about the door pivot axis with lower part heavier, this unbalance tending to promote sealing of the lower part of the door against the wall; and a counterweight is associated with the pivot link means to partially counterbalance the weight of the door about the link pivot axis to reduce the effort required for second phase movement; alternatively, the first edge of the opening is an upright side edge of the opening; in either arrangement, preferably flexible gasketing means are associated with edges of the first part of the door to accommodate inward and the outward motion of said first part during the two phases of motion during opening of the door.

PREFERRED EMBODIMENT

The structure and operation of a preferred embodiment of the invention will now be described, after describing the drawings.

DRAWINGS

FIG. 1 is a perspective front view partially in section of said preferred embodiment.

FIG. 2 is a rear view of said preferred embodiment.

FIG. 3 is a side view in section at 3—3 of FIG. 1.

STRUCTURE

Figure 18:
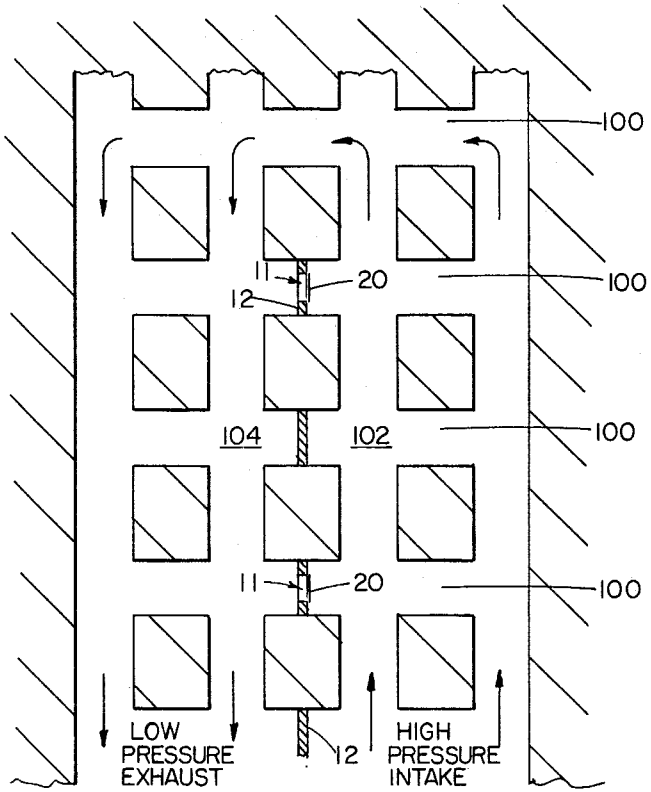
FIG. 18 is a diagrammatic top view in section of a typical coal mine.

In FIG. 1, access opening 11 in stopping 12 is closed by door assembly 10. The stopping is typically of concrete or cement block, the opening being 32 inches square, i.e., 4 blocks high by 2 blocks wide. The access opening is surrounded by frame 14, typically of bent sheet metal, for support and to provide a more uniform sealing surface. As shown in FIG. 18 the stopping 12 is located in crosscut 100 between ventilation air intake heading 102 and ventilation air exhaust heading 104. The air pressure in intake heading 102 is typically 2 to 4 inches of water higher than the air pressure in exhaust heading 104.

Door assembly 10 consists of door 20, pivot links 42, and door handle 28. Door 20 is typically of sheet metal, of sufficient thickness, e.g. $\frac{1}{8}$ inch thick, for the pressure loading anticipated, and is located on the higher pressure side of stopping 12, i.e., on the intake heading 102 side of stopping 12. Door handle 28 is located on the higher pressure face of door 20, typically near the bottom.

The top and the sides of upper section 22 of door 20 are slightly recessed from the top edge 32 and the side edges 34, 36 of access opening 11. Seals 50 attached to frame 14 on the higher pressure side 102 of stopping 12 extend across the slight gaps between frame 14 and upper section 22 of door 20 to reduce air leakage between frame 14 and proximal door section 22 when door 20 is in the closed position. The sides and the bottom of the lower section 24 of door 20 extend beyond the bottom edge 38 and the side edges 34, 36 of access opening 11. If desired, flexible seals may also be placed between frame 14 and the coacting portions of lower door section 24 to provide additional sealing against air leakage. These seals may be attached either to frame 14 or to door 20 as is desired.

Pivot links 42 are connected to door 20 at horizontal axis 40, the lower end of links 42 being engaged in door brackets 52. The upper ends of links 42 are engaged in holes in upper brackets 54 to pivot about horizontal link pivot axis 56. The links serve to support the weight of door 20. The location of brackets 54 inwardly assists in keeping door 20 in the sealed closed position.

Figure 9:
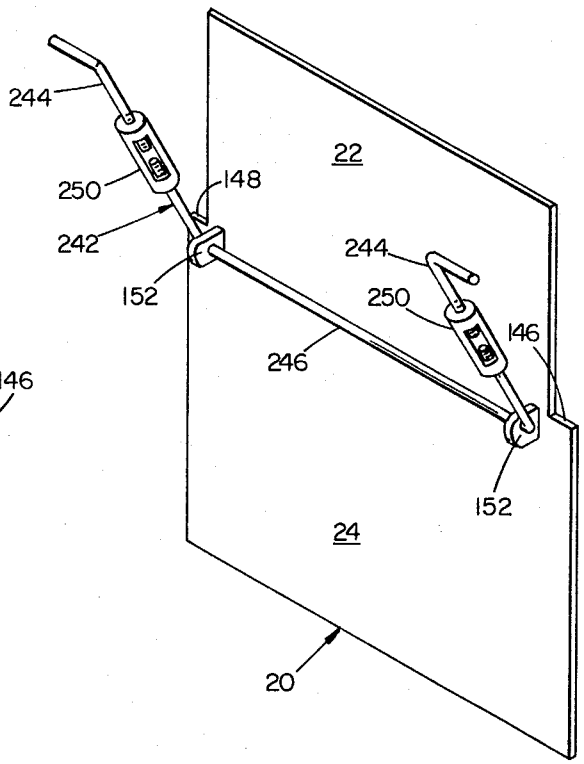
FIGS. 7, 8 and 9 are rear views in perspective of alternate embodiments of the pivot link arms of the invention.
Figure 8:
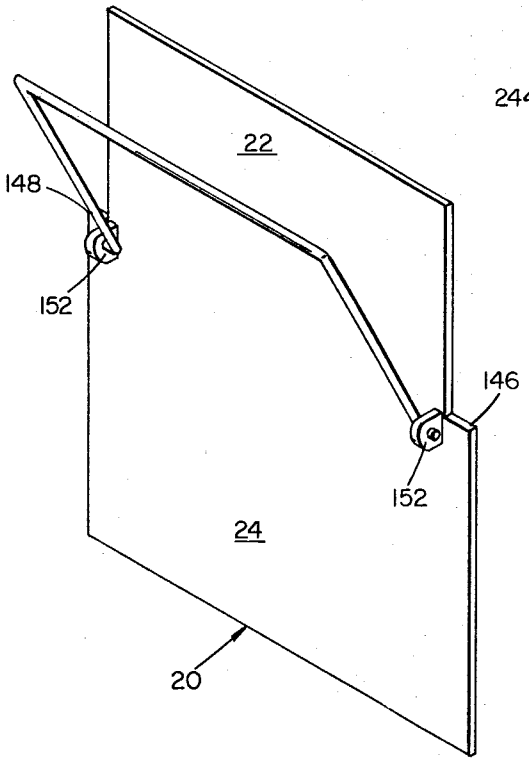
Figure 7:
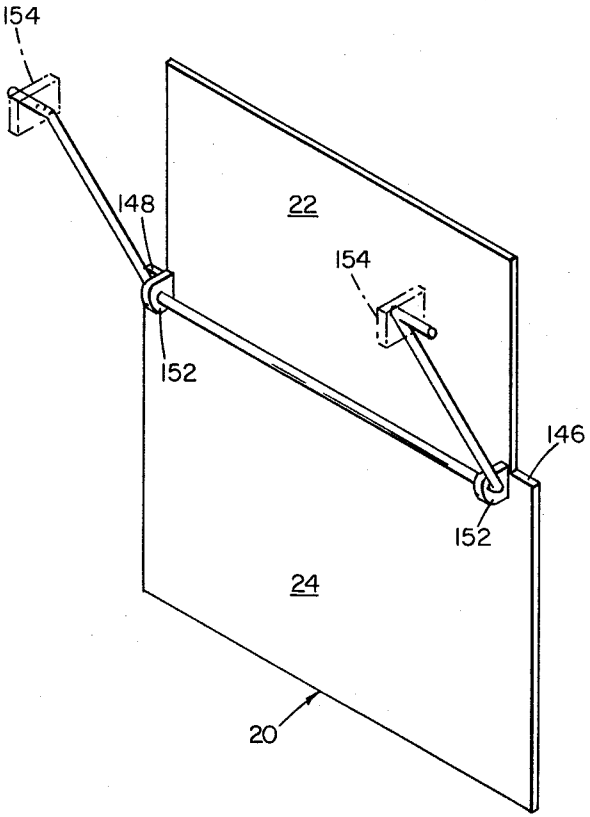
Figure 11:
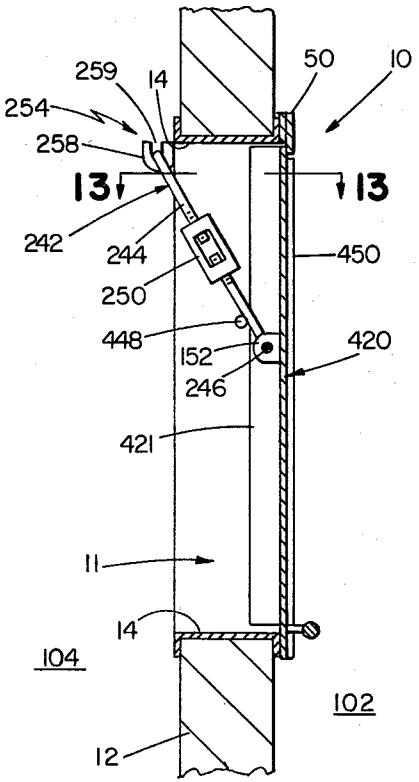
FIG. 11 is a side view in section of the alternate embodiment of the invention at 11—11 of FIG. 10.

In the preferred embodiment, pivot links 42 are two independent bars of sufficient strength and rigidity to support the weight of door 20 through repeated opening and closing operations. In alternate embodiments, the pivot links may be formed of a single unit from a simple bent rod with the end portions engaging the holes in the upper brackets 154 as shown in FIG. 7, or engaging the holes in the lower door brackets 152 as shown in FIG. 8. In another embodiment shown in FIG. 9, the pivot link 242 is comprised of an upper arm section 244 and a lower arm section 246. Both arm sections are threaded at the adjacent extremities to be joined by turnbuckle 250. Turnbuckle 250 allows easy adjustment of the position of door 20 for variations in access openings and in the locations of the brackets. The height of door 20 may be adjusted up or down by turning both turnbuckles in the same direction; while adjusting one turnbuckle independently of the other turnbuckle will change the angle of door 20. An alternate configuration for the upper brackets is shown in FIG. 11 wherein upper bracket 254 consists of a support 258 that has an open notch 259 at the top to receive the upper end of the pivot link thereby allowing easy installation and removal of the door assembly.

Laterally extending edges 46, 48, delineating between the upper section 22 and lower section 24 of door 20, coact with frame 14 to create pivot axis 40' about which door 20 pivots relative to the frame during Phase 1 of the opening operation discussed below. The edges 46, 48 are located in the vicinity of the pivotal connection of the door to links 42, but, as shown, some offset can be provided. The location of pivot axis 40' is predetermined for a known desired force F, which is the amount of force required to pivot the door about edges 46, 48 by means of the coaction of edges 46, 48 with frame 14. Assuming that F is applied opposite the bottom of opening 11, it is given by:

$$F = \frac{pW}{2}\left[B - \frac{A^2}{B}\right]$$

where p=pressure drop across the door w=width of the opening

Figure 4:
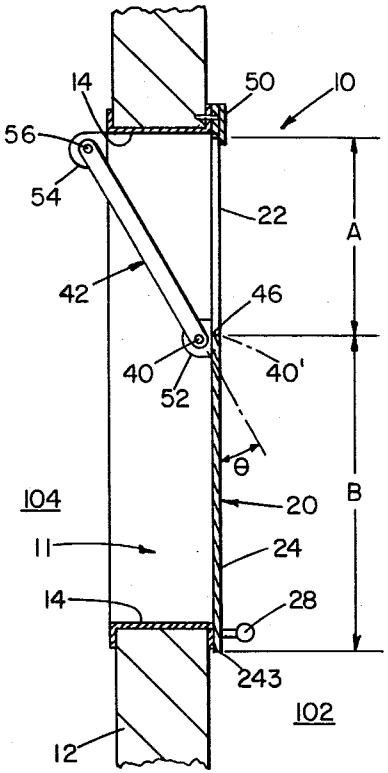
FIG. 4 is a side view in section at 4—4 of FIG. 1 showing the door in the closed position.

B & A as shown in FIG. 4

It can be seen that if edges 46, 48 are exactly in the middle, A and B are equal and F is zero. In the preferred embodiment, edges 46, 48 would be placed above the middle to assure a slight positive F, thus assuring that, in combination with gravity, the door will be self-closing.

OPERATION

As shown in FIG. 4, door 20 is in the closed position sealing access opening 11 in stopping 12 between intake heading 102 and exhaust heading 104, the door being on the higher pressure, or intake heading, side of the stopping.

To operate door assembly 10 in Phase 1, the operator, if on the higher pressure side 102, pulls handle 28 at the base of door 20 toward him. If the operator is on the lower pressure side 104 he, or she, pushes on the rear base of door 20. This action causes door 20 to pivot on edges 46, 48 (edge 46 shown) against frame 14. Upper section 22 of door 20 rotates into access opening 11, while lower section 24 of door 20 rotates away from access opening 11. (Rotation in the opposite direction is prevented by the engagement of the extended side edges 241, and the bottom edge 243 of lower section 24 against the frame 14.) Because in this embodiment axes 40 and 40' are offset, edges 46, 48 also slide slightly upward along frame 14 because pivot links 42 constrain pivot axis 40 to pivot in an arc about upper bracket 54. Because the door pivots nearly at its center, very little force is necessary to overcome the door weight and the pressure drop across the access opening. Door 20 pivots to angle Θ where the rear face of door 20 engages on pivot links 42. At this point, the door is essentially open to air flow and the pressure drop is substantially relieved in the region of the door. Angle Θ is determined by the location of the upper brackets 54, the angle of rotation decreasing as the position approaches the rear face of door 20, and increasing as the bracket is moved inwardly away from the door. The amount of opening in Phase 1 also changes in proportion to the change in Θ.

Figure 6:
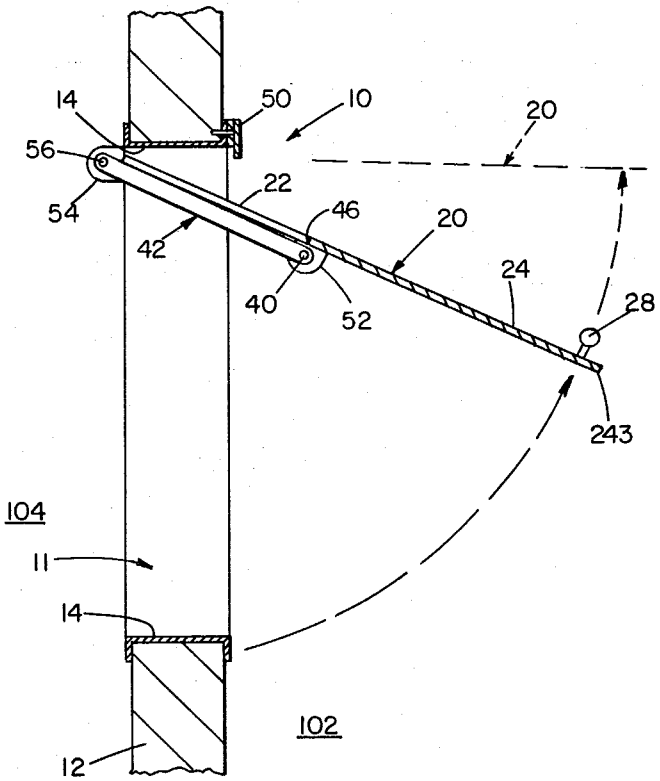
FIG. 6 is a side view section showing the door in the full open position (Phase 2).
Figure 5:
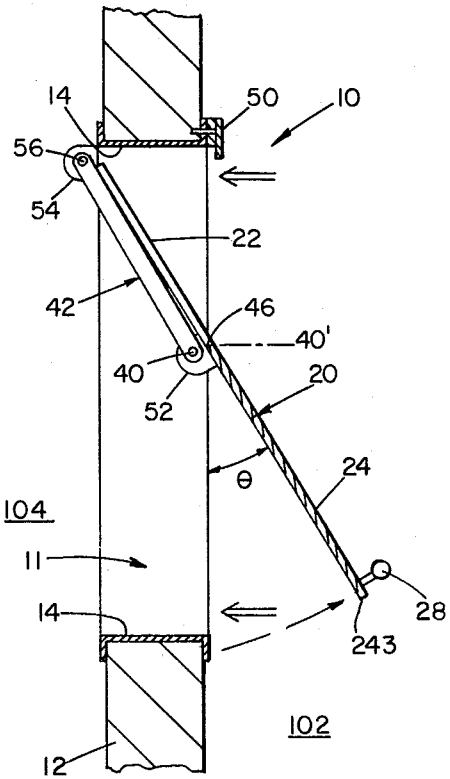
FIG. 5 is a side view in section showing the door partially opened (Phase 1).
Figure 12:
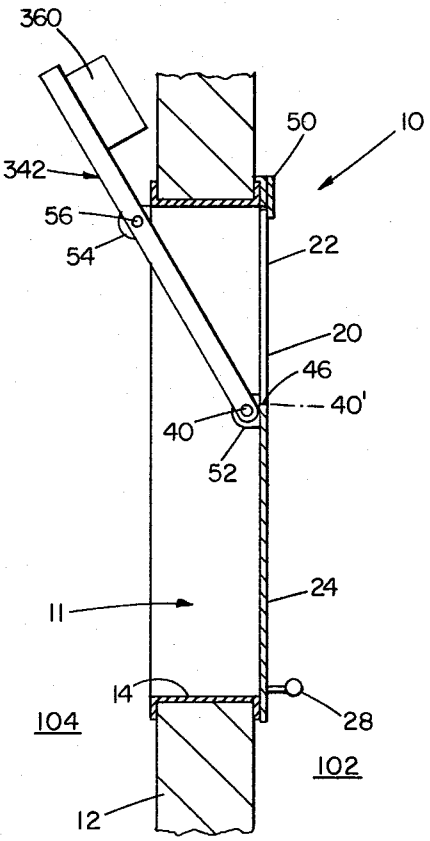
FIG. 12 is a side view in section of an alternate embodiment of the invention.

In Phase 2, the door assembly, consisting of the door 20 and pivot links 42, pivots as a unit about upper bracket 54 as the door is raised to a horizontal position (shown in dashed lines in FIG. 6) where the face of door 20 engages against frame 14. In the preferred embodiment, the Phase 2 operation requires the operator to physically move the weight of the door assembly about the upper pivot axis. In an alternate embodiment shown in FIG. 12, pivot link arm 342 is extended beyond upper bracket 54 to support counter weight 360 which is predetermined to partially offset the weight of the door assembly to decrease the force required in Phase 2.

When the door assembly is released after the operator passes through, the door automatically returns to the closed position shown in FIG. 4. This is caused by the weight of door assembly 10 acting by gravity to pivot the assembly down about the pivot axis at upper bracket 54. The predetermined dimensions of A and B, where B>A, also cause lower section 24 of door 20 to simultaneously pivot downward about the pivot axis at door brackets 52 on pivot links 42. The pivoting of door 20 is caused by a combination of gravity and the effects of the air flow from higher pressure region 102 to lower pressure region 104, the effect on the larger surface area of lower section 24 overcoming the similar but lesser effect on the smaller surface area of upper section 22. The difference in air pressure which increases as the door assembly restricts the area of the access opening, causes door 20 to return to the sealing position shown in FIG. 4. Further rotation of door 20 about pivot axis 40 through the vertical position of FIG. 4 is prevented by the dimensions of the lower section of the door which cause the extended faces 241, 242, and 243 of the door 20 to engage the frame 14 about the access opening 11 and act as a stop to further rotation.

OTHER EMBODIMENTS

Figure 10:
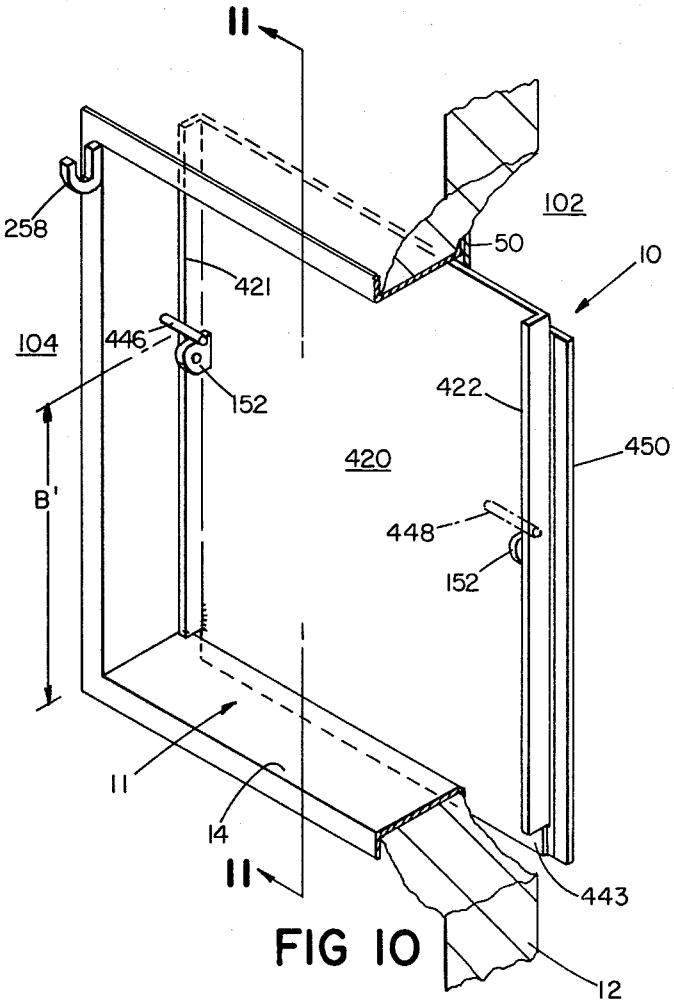
FIG. 10 is a rear view in perspective of an alternate embodiment of the door of the invention.
Figure 16:
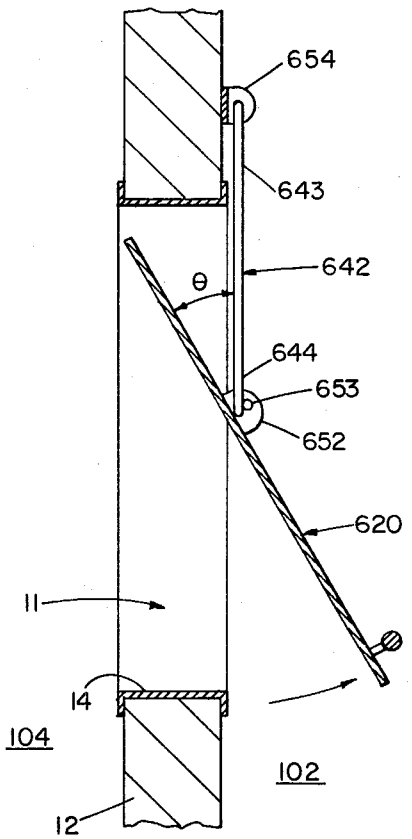
FIGS. 15 and 16 are side views in section of alternate embodiments of the second pivot axis of the invention.
Figure 15:
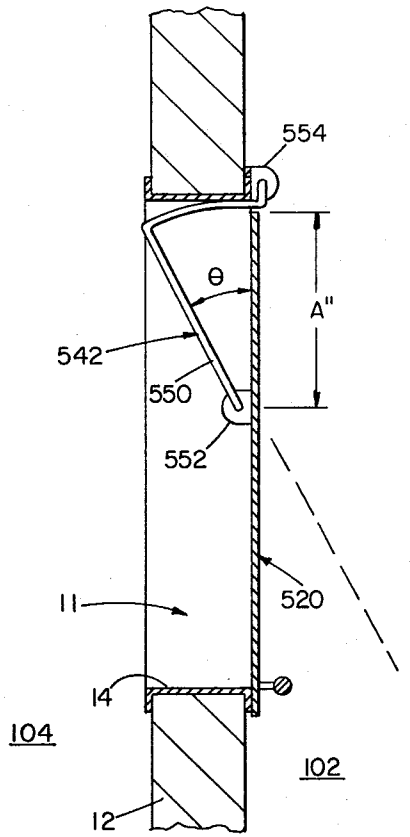
Figure 13:
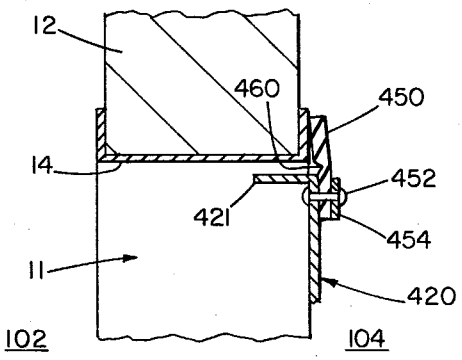
FIG. 13 is a partial top view in section of the door seal at 13—13 of FIG. 11.
Figure 14:
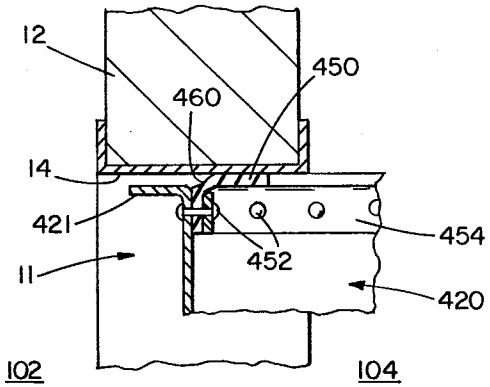
FIG. 14 is a partial top view in section of the door seal of FIG. 13 in the open position.

As shown in FIG. 10, door 420 may be made of a sheet which is rolled at the longitudinal edges 421, 422 to provide additional strength against buckling under pressure. In this embodiment, the sides and the top are recessed within the frame of the access opening, rods 446, 448 extending at a predetermined height B' from the side walls of access opening, serving to limit inward movement of the links. (In this case motion during phase I is pure rotation about axis 40). The stop against rotation of the lower section of the door into the access opening is provided by the bottom edge 443 of door 420 which extends below the bottom edge of access opening 11. Gaskets to seal the gaps between the door and the frame around the access opening are not in all cases necessary, but where desired may be provided as in FIGS. 13 and 14. Gasket 450 of some compliant material, e.g. elastomeric or scrap belting, is attached to door 420 over its entire longitudinal length by rivets 452 through reinforcing metal strip 454. Where the upper section of door 420 moves inwardly during the first phase of the opening motion, gasket 450 bends at longitudinal groove 460, which acts as a flexible hinge, to allow the unattached section to follow frame 14. When the upper door section moves outwardly during the second phase of the opening motion, the relatively stiff, outer angled section of the gasket moves outwardly without folding over to become jammed between the door and the frame, continuing in the angled position until clear of the frame. When the door is closed, gasket 450 returns to the sealing position.

Where it is necessary, the door of the invention may be suspended from upper brackets located on the high pressure side of stopping 12. In FIG. 15, the pivot link 542 consists of angled bar 550, the lower section engaging in door bracket 552 on the inward side of door 520 and extending inwardly at an angle of Θ degrees over a length greater than A" (the height of the upper section of the door); the bar 550 then angles outward to pass between the top of door 520 and frame 14 to engage upper brackets 554 located above access opening 11 on the high pressure side 102 of stopping 12. In another embodiment, shown in FIG. 16, straight pivot link 642 engaging at its upper extremity 643 in upper bracket 654 that is located above access opening 11 on the high pressure side 102 of stopping 12, is engaged at its lower extremity 644 in door bracket 652 which is also located on the high pressure side 102 of stopping 12. The rotation of door 620 is limited to angle $\theta$ by pin 653 in door bracket 652 which engages against pivot link 642 when $\theta$ is reached.

Figure 17:
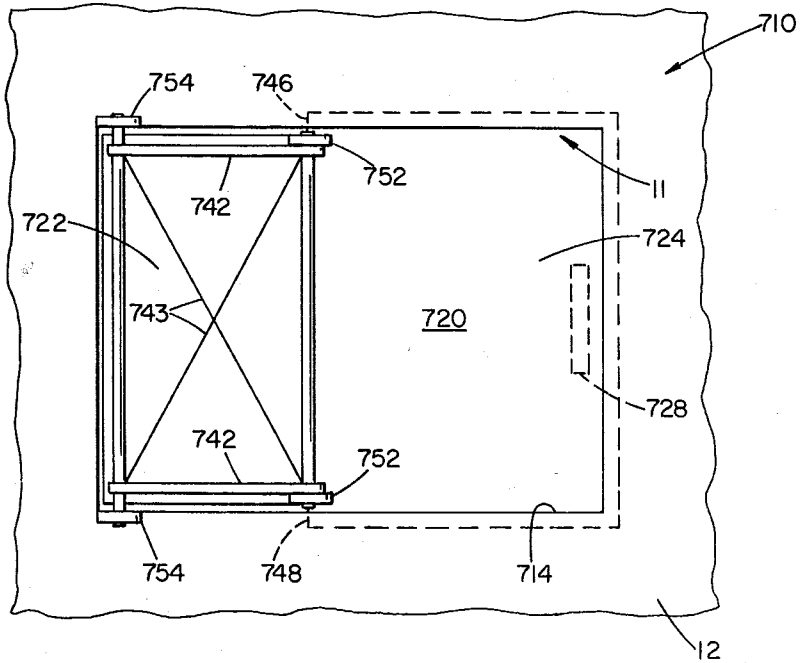
FIG. 17 is a front view in perspective showing a horizontal operating alternate embodiment of the invention.

In another embodiment, as shown in FIG. 17, the door assembly of the invention may be operated in the horizontal direction. Door 720 is suspended by pivot links 742 which engage door brackets 752 and wall brackets 754. Pivot links 742 are supported by diagonal braces 743. To operate, handle 728 on high pressure side 102 of stopping 12 is pulled toward the operator. Door 720 rotates on edges 746, 748 against frame 714 causing proximal section 722 to move into access opening 11 while distal section 724 moves outward until the inner face of door 720 engages against links 742, thereby relieving the difference in air pressure. In Phase 2' the door and link assembly 710 pivot as a unit at wall brackets 754 until door 720 is perpendicular from the wall surrounding access opening 11. The location of edges 746, 748 is again predetermined for a known F to reduce the force required to open the door. To close the door, it must be manually returned to a near closed position for the air flow to take effect.

I claim:

1. An easy-to-open, pressure-resistant door assembly for an access opening of predetermined shape in a wall, said wall disposed between high and low air pressure regions in a mine or the like, with the door located on the high pressure side of the opening and air pressure drop across the door serving to keep the door sealed, said door having a first edge corresponding to a first edge of said access opening and a door pivot axis spaced from said first door edge a substantial distance in the direction of the opposite second edge of said door, the first part of said door that extends between said first door edge and said door pivot axis having a width slightly narrower than the corresponding part of said predetermined access opening to enable pivotal movement of said first part of said door about said door pivot axis inwardly of said access opening toward the low pressure region while the second part of said door, on the opposite side of said door pivot axis, pivots outwardly toward the high pressure region, a pivot link means pivotally supporting said door in the region of said door pivot axis and extending to a link pivot axis parallel to the door pivot axis and located in the region of said first edge of said access opening, a limit means adapted to limit the pivotal movement of said door about said door pivot axis to an acute angle, and said pivot link means arranged to swing said door pivot axis and the door supported thereby outwardly about said link pivot axis to move said door pivot axis in the direction toward a line projected perpendicular to said wall from said link pivot axis, and stop means adapted to prevent the part of said door adjacent said second edge from moving inwardly through said opening, whereby, upon application of operator force for opening said door, as by pushing or pulling by one hand of the operator, said door can respond in successive first and second phases of opening motion, in said first phase of opening motion said door responding by pivoting through an acute angle about said door pivot access, the exposure of the door to high air pressure resisting bodily rotation of said door and link means about said link pivot axis, while distribution of the pressure on opposite sides of said door pivot axis enables said first phase of motion about said door pivot axis to occur with relatively small operator force, said first phase of motion enabling substantial equilibration of air pressure on both sides of said door in the region of said access opening, and in said subsequent second phase of opening motion said link means enabling bodily swinging of said door and link means about said link pivot axis after said equilibration of air pressure to complete the movement of said door relatively easily to its open position to permit unobstructed access through said opening.

2. The door assembly of claim 1 wherein said stop means comprises a peripheral margin of said second part of said door sized larger than the corresponding part of said opening, said margin adapted effectively to seat and seal against said wall.

3. The door assembly of claim 1 wherein said link means serves as said limit means to limit pivotal movement of said door about said door pivot axis to said acute angle.

4. An easy-to-open, pressure-resistant door assembly for an access opening of predetermined shape in a wall, said wall disposed between high and low air pressure regions in a mine or the like, with the door located on the high pressure side of the opening and air pressure drop across the door serving to keep the door sealed, said door having a first edge corresponding to the upper edge of said access opening and a horizontal door pivot axis spaced downwardly from said first door edge a substantial distance, the part of said door above said door pivot axis having a width slightly narrower than the corresponding part of said predetermined access opening to enable pivotal movement of the upper part of said door about said door pivot axis inwardly of said access opening toward the low pressure region while the lower part of said door, below said door pivot axis, pivots outwardly toward the high pressure region, a pivot link means pivotally supporting said door in the region of said door pivot axis and extending to a link pivot axis parallel to the door pivot axis and located in the region of the upper edge of said access opening a limit means adapted to limit the pivotal movement of said door about said door pivot axis to an acute angle, and said pivot link means arranged to swing said door pivot axis and the door supported thereby outwardly about said link pivot axis to move said door pivot axis in the direction toward horizontal alignment with said link pivot axis, and stop means adapted to prevent the lower part of said door from moving inwardly through said opening, whereby, upon application of operator force for opening said door, as by pushing or pulling by one hand of the operator, said door can respond in successive first and second phases of opening motion, in said first phase of opening motion said door responding by pivoting through an acute angle about said door pivot axis, the exposure of the door to high air pressure resisting bodily rotation of said door and link means about said link pivot axis, while distribution of the pressure on opposite sides of said door pivot axis enables said first phase of motion about said door pivot axis to occur with relatively small operator force, said first phase of motion enabling substantial equilibration of air pressure on both sides of said door in the region of said access opening, and in said subsequent second phase of opening motion said link means enabling bodily swinging of said door and link means about said link pivot axis after said equilibration of air pressure to complete the movement of said door relatively easily to its open position to permit unobstructed access through said opening, upon release of said door by the operator, the weight of said door serving to cause said door to swing back about said pivot link axis toward closed position, said door being slightly unbalanced in weight about said door pivot axis with the lower part of said door being heavier than the upper part, said weight unbalance tending to pivot said door about said door pivot axis to promote sealing of the lower part of said door against said wall.

5. The door assembly of claim 1 or 4 wherein the effective moment of the area of said first part of said door about said door pivot axis is slightly less than the moment of the area of said second part of said door about said axis so that in the absence of operator force the effect of pressure differential acting on said two parts of said door is to produce a slight unbalance tending to rotate said door about said door pivot axis in the direction to keep said door closed, with said door engaged with said stop means.

6. The door assembly of claim 4 wherein said pivot link means comprises a pair of links, one at each side of said access opening, said links extending substantially parallel from said link pivot axis to said door pivot axis.

7. The door assembly of claim 4 wherein said link pivot axis is spaced inwardly from the high pressure side of said opening, whereby the weight of said door continues to urge said door to swing inwardly about said link pivot axis when the door is seated against said wall, whereby the weight of said door helps to promote sealing of said door against said wall.

8. The door assembly of claim 4 including a counterweight associated with said pivot link means to partially counterbalance the weight of said door assembly about said link pivot axis to enable said second phase movement to occur with less effort of the operator.

9. The door assembly of claim 1 or 4 wherein flexible gasketing means are associated with edges of said first part of said door adapted to accommodate inward motion of said part during first phase and outward motion during second phase of opening of said door.

10. The flexible gasketing of claim 9 wherein a first longitudinal section of said gasket is fixed, and the opposite longitudinal section of said gasket is an unfixed, stiff member, said unfixed member extending across the opening between the door and frame; said longitudinal gasket sections being connected by a flexible hinging means.

11. The door assembly of claim 1 or 4 having edges that bear upon said frame, defining a pivot axis of said door against said frame.

12. The door assembly of claim 11 in which said link means are pivotally connected to said door at a position offset from said edges, whereby rotation of said door about said edges is accompanied by sliding movement of said edges along said frame.

* * * * *